US011839784B2

(12) United States Patent
Lee

(10) Patent No.: US 11,839,784 B2
(45) Date of Patent: Dec. 12, 2023

(54) FIRE SUPPRESSION SYSTEM

(71) Applicants: Young Sook Lee, Yongin-si (KR); Yong Taek Moon, Yongin-si (KR)

(72) Inventor: Young Sook Lee, Yongin-si (KR)

( * ) Notice: Subject to any disclaimer, the term of this patent is extended or adjusted under 35 U.S.C. 154(b) by 0 days.

(21) Appl. No.: 17/925,594

(22) PCT Filed: Dec. 2, 2020

(86) PCT No.: PCT/KR2020/017483
§ 371 (c)(1),
(2) Date: Nov. 15, 2022

(87) PCT Pub. No.: WO2021/246596
PCT Pub. Date: Dec. 9, 2021

(65) Prior Publication Data

US 2023/0191175 A1 Jun. 22, 2023

(30) Foreign Application Priority Data

Jun. 3, 2020 (KR) ..... 10-2020-0067257

(51) Int. Cl.
*A62C 31/05* (2006.01)
*A62C 37/12* (2006.01)
(Continued)

(52) U.S. Cl.
CPC ..... *A62C 31/05* (2013.01); *A62C 37/12* (2013.01); *A62C 37/38* (2013.01);
(Continued)

(58) Field of Classification Search
CPC ..... A62C 35/023; A62C 37/38; A62C 31/05; A62C 99/0018
See application file for complete search history.

(56) References Cited

U.S. PATENT DOCUMENTS 5,984,016 A * 11/1999 Samuelsson ..... A62C 3/07 169/73
10,022,575 B2 * 7/2018 Bosma ..... A62C 3/004
(Continued)

FOREIGN PATENT DOCUMENTS

CN 211561680 U 9/2020
JP 11-283146 A 10/1999
(Continued)

*Primary Examiner* — Joseph A Greenlund
(74) *Attorney, Agent, or Firm* — Maschoff Brennan

(57) ABSTRACT

A fire suppression system according to an embodiment of the present invention comprises: a detection unit for detecting a particular change due to a fire and transmitting a particular change value as a measurement value; a fire extinguishing unit for spraying a fire extinguishing substance; a control unit for receiving the measurement signal and transmitting an execution signal to the fire extinguishing unit; and a management unit enabling a user or a manager to confirm whether or not there is a fire, and for remotely operating the fire extinguishing unit, wherein the control unit transmits a notification signal to the management unit only when a measured measurement data value exceeds a threshold value, and transmits the execution signal only when an operation command is received from the management unit, thereby enhancing convenience and safety and reducing the initial cost.

5 Claims, 10 Drawing Sheets

(51) Int. Cl.

| | |
|---|---|
| ***A62C 37/38*** | (2006.01) |
| ***A62C 99/00*** | (2010.01) |
| ***G08B 25/08*** | (2006.01) |
| ***G08B 25/14*** | (2006.01) |

(52) U.S. Cl.
CPC ..... *A62C 99/0018* (2013.01); *G08B 25/08* (2013.01); *G08B 25/14* (2013.01)

(56) References Cited

U.S. PATENT DOCUMENTS

| | | | | |
|---|---|---|---|---|
| 10,058,722 | B2 * | 8/2018 | Hopfe | A62C 99/0018 |
| 10,363,446 | B2 * | 7/2019 | Lenkeit | A62C 99/0018 |
| 2003/0079888 | A1 * | 5/2003 | Sundholm | A62C 35/68 169/65 |
| 2010/0230118 | A1 * | 9/2010 | Fabre | A62C 35/023 169/9 |
| 2011/0290510 | A1 * | 12/2011 | Hanratty | A62C 13/64 169/74 |
| 2013/0341055 | A1 | 12/2013 | Kochelek et al. | |
| 2020/0222934 | A1 * | 7/2020 | Krutskevych | B05B 15/72 |
| 2022/0072353 | A1 * | 3/2022 | Kho | A62C 35/023 |
| 2023/0036315 | A1 * | 2/2023 | Savage, Jr | A62C 3/006 |

FOREIGN PATENT DOCUMENTS

| | | | |
|---|---|---|---|
| KR | 10-2008-0068779 | A | 7/2008 |
| KR | 20-2009-0004970 | U | 5/2009 |
| KR | 10-2012-0065594 | A | 6/2012 |
| KR | 10-2015-0025844 | A | 3/2015 |
| KR | 10-1524779 | B1 | 6/2015 |
| KR | 10-2017-0011061 | A | 2/2017 |
| KR | 10-1748748 | B1 | 6/2017 |
| KR | 10-1890517 | B1 | 8/2018 |
| KR | 10-1947067 | B1 | 2/2019 |
| KR | 10-2019-0074034 | A | 6/2019 |
| KR | 10-2026969 | B1 | 9/2019 |
| KR | 10-2115292 | B1 | 5/2020 |
| KR | 10-2194180 | B1 | 12/2020 |

* cited by examiner

[FIG. 1]
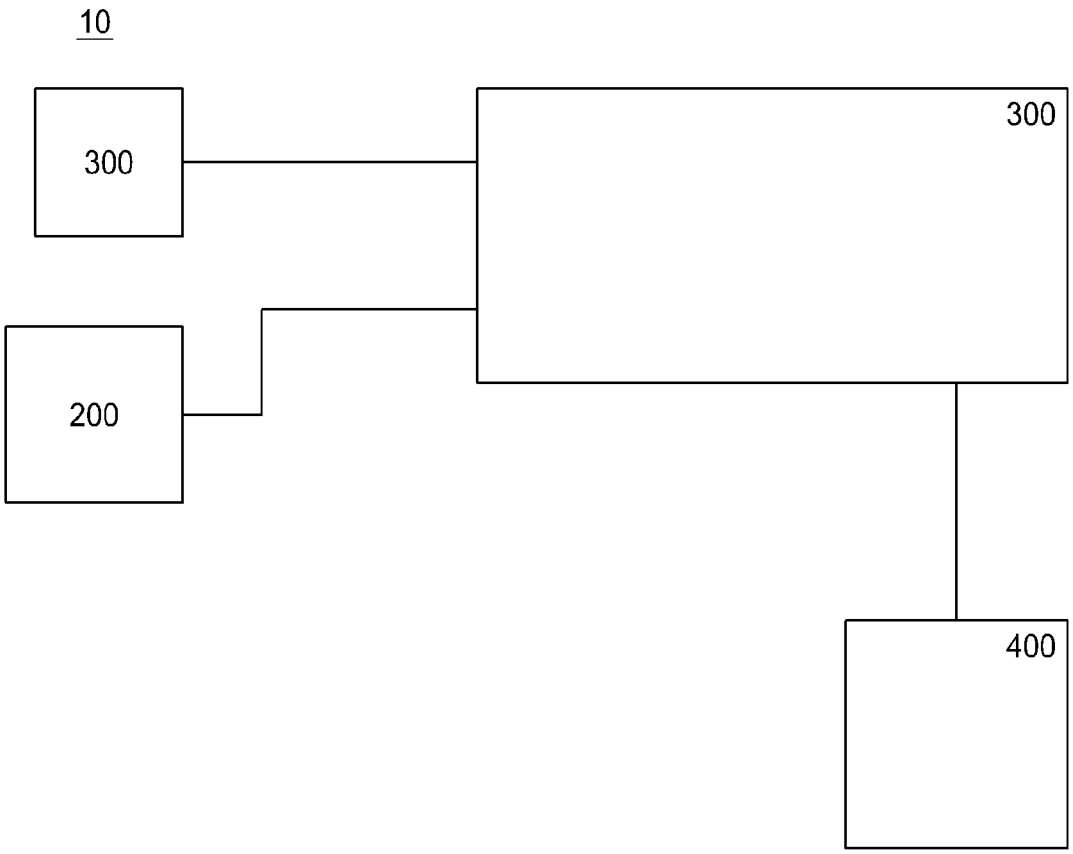

[Fig. 2]
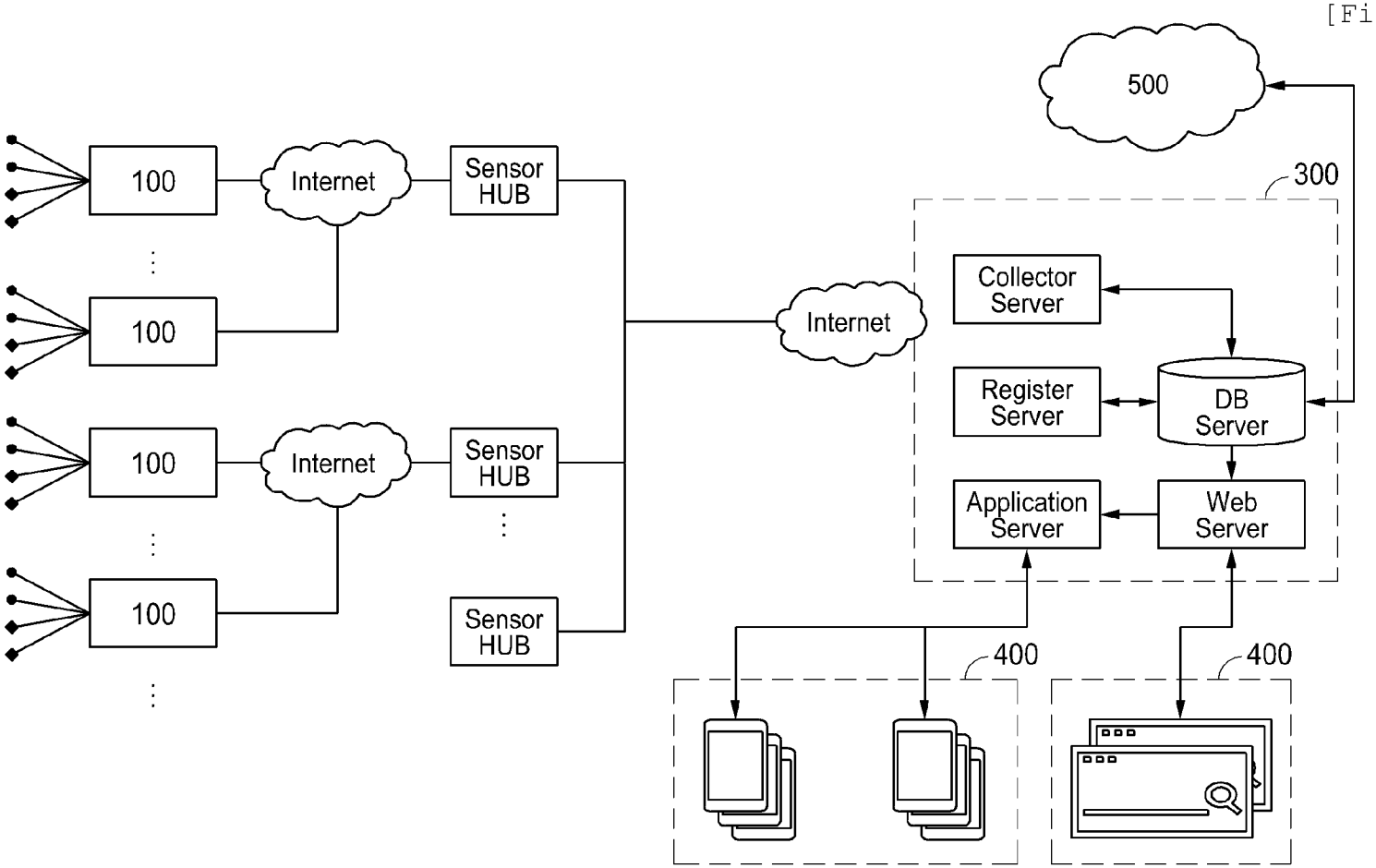

[FIG. 3]
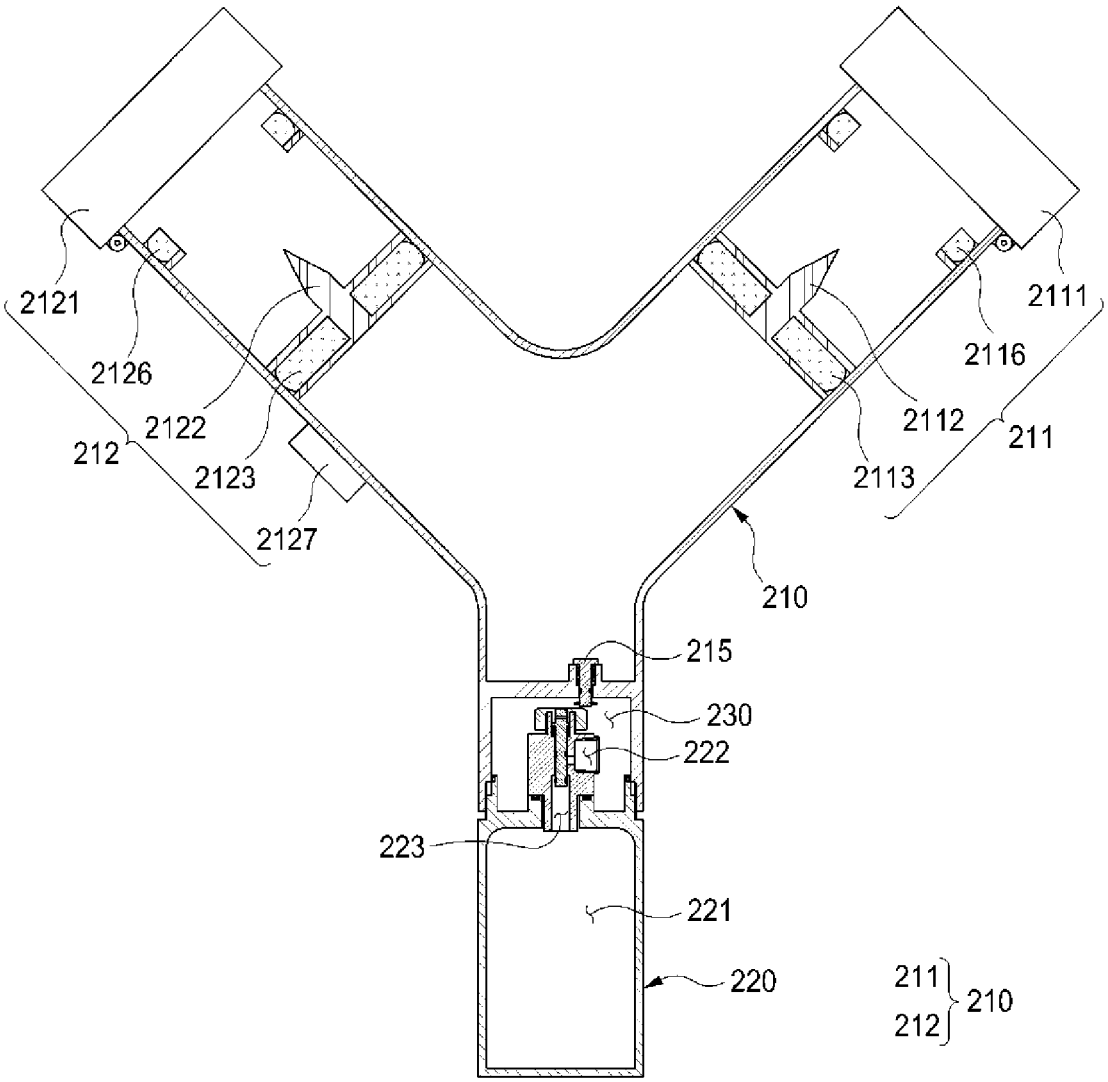

[FIG. 4]
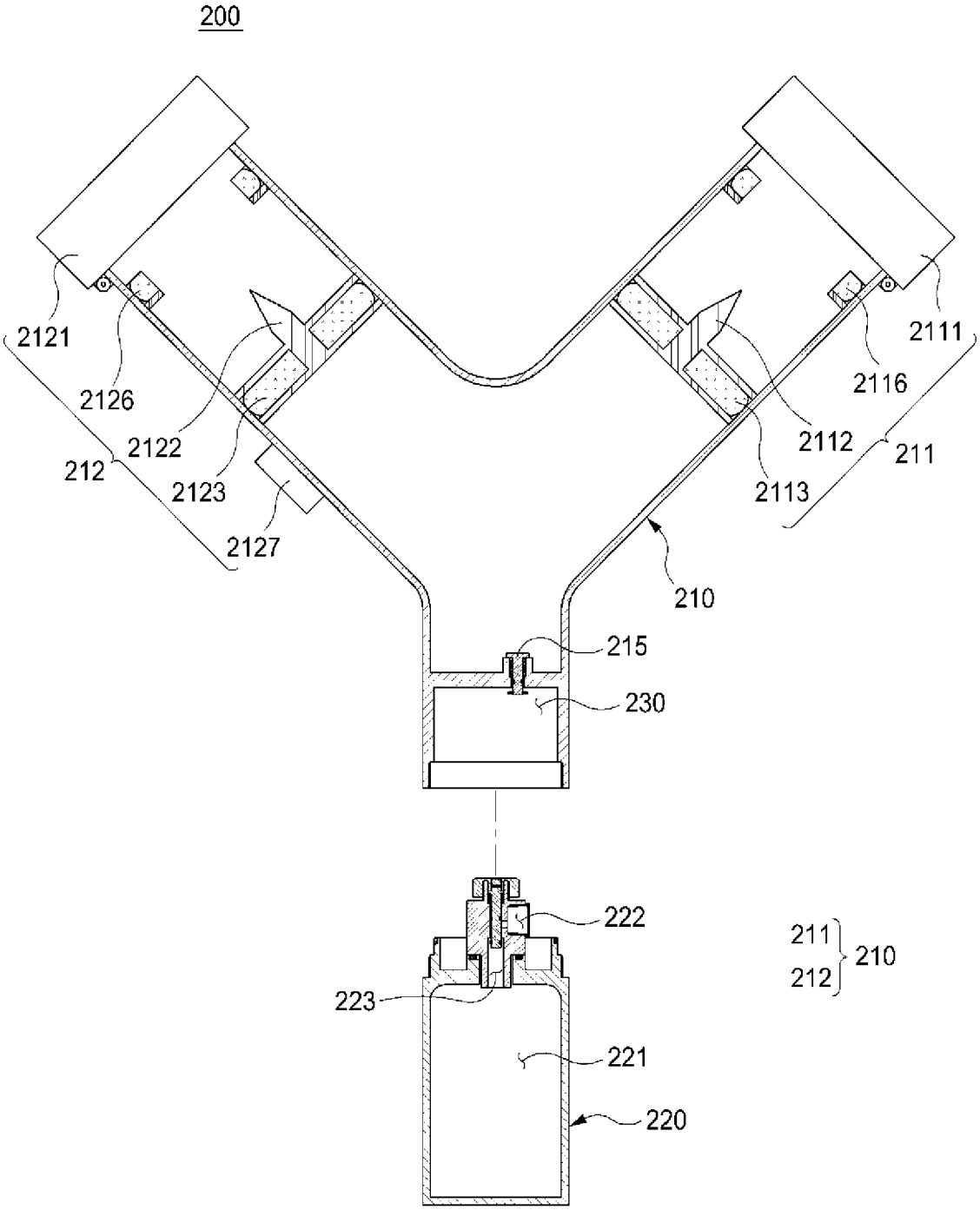

[Fig. 5a]
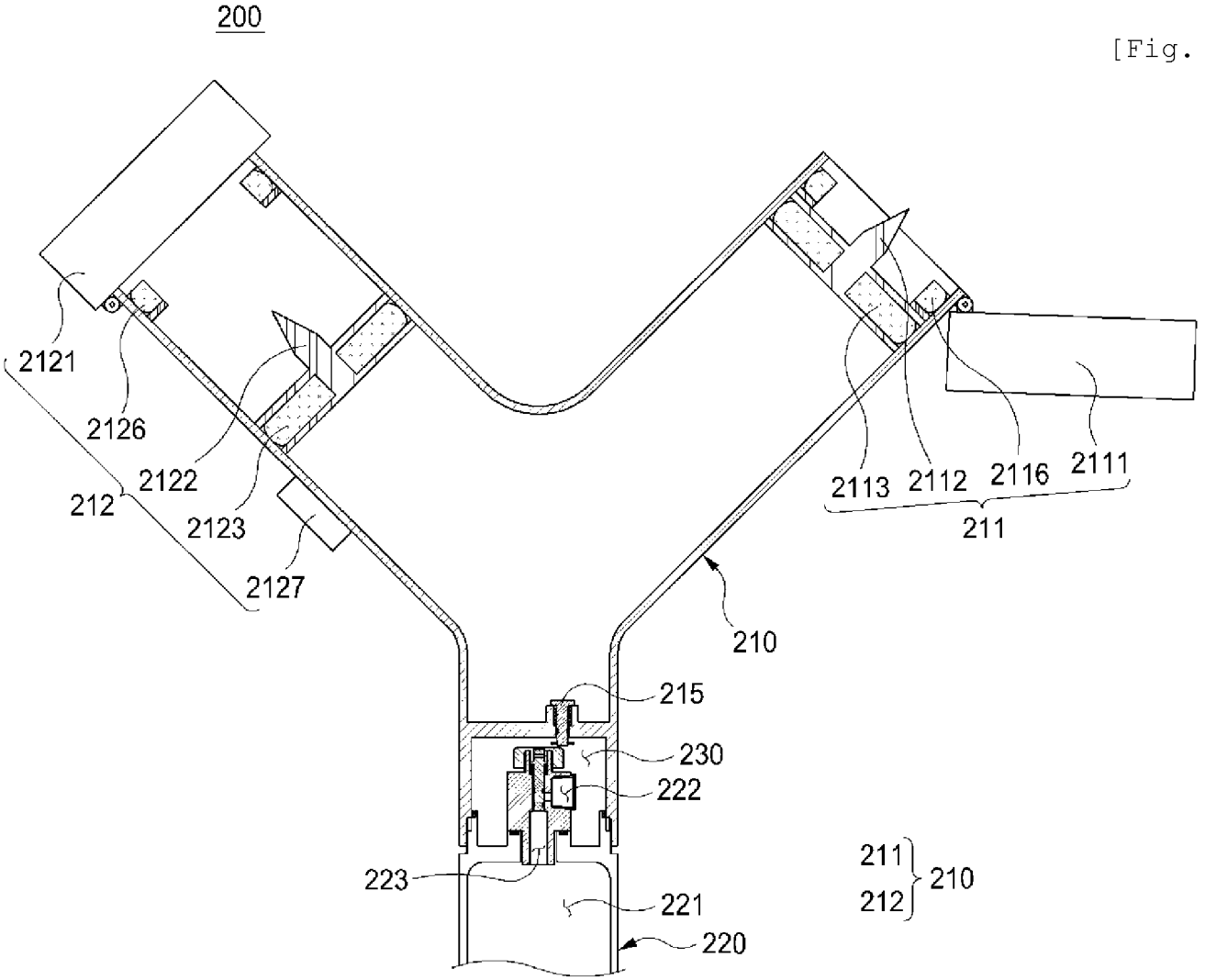

[Fig. 5b]
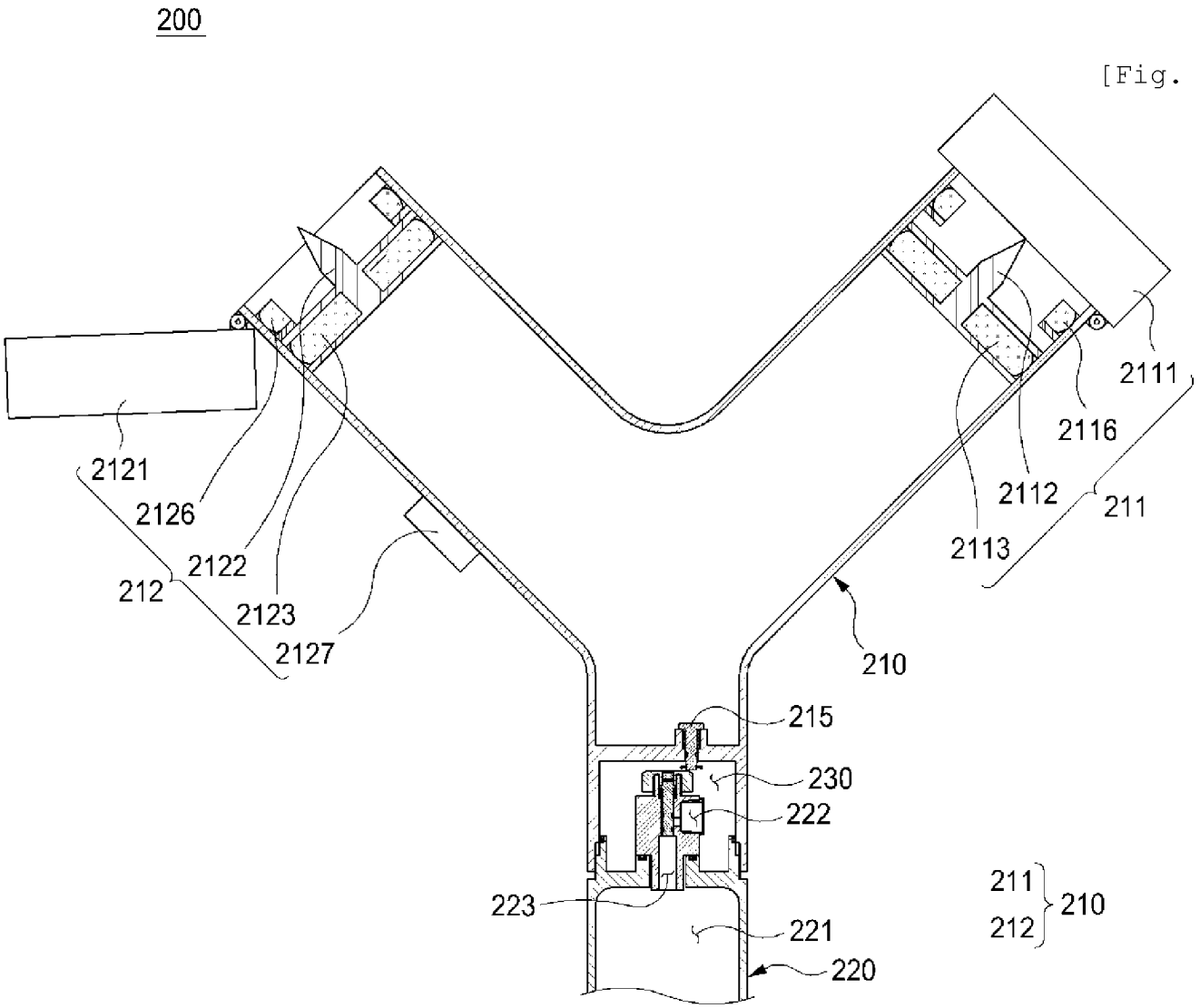

[FIG. 6a]
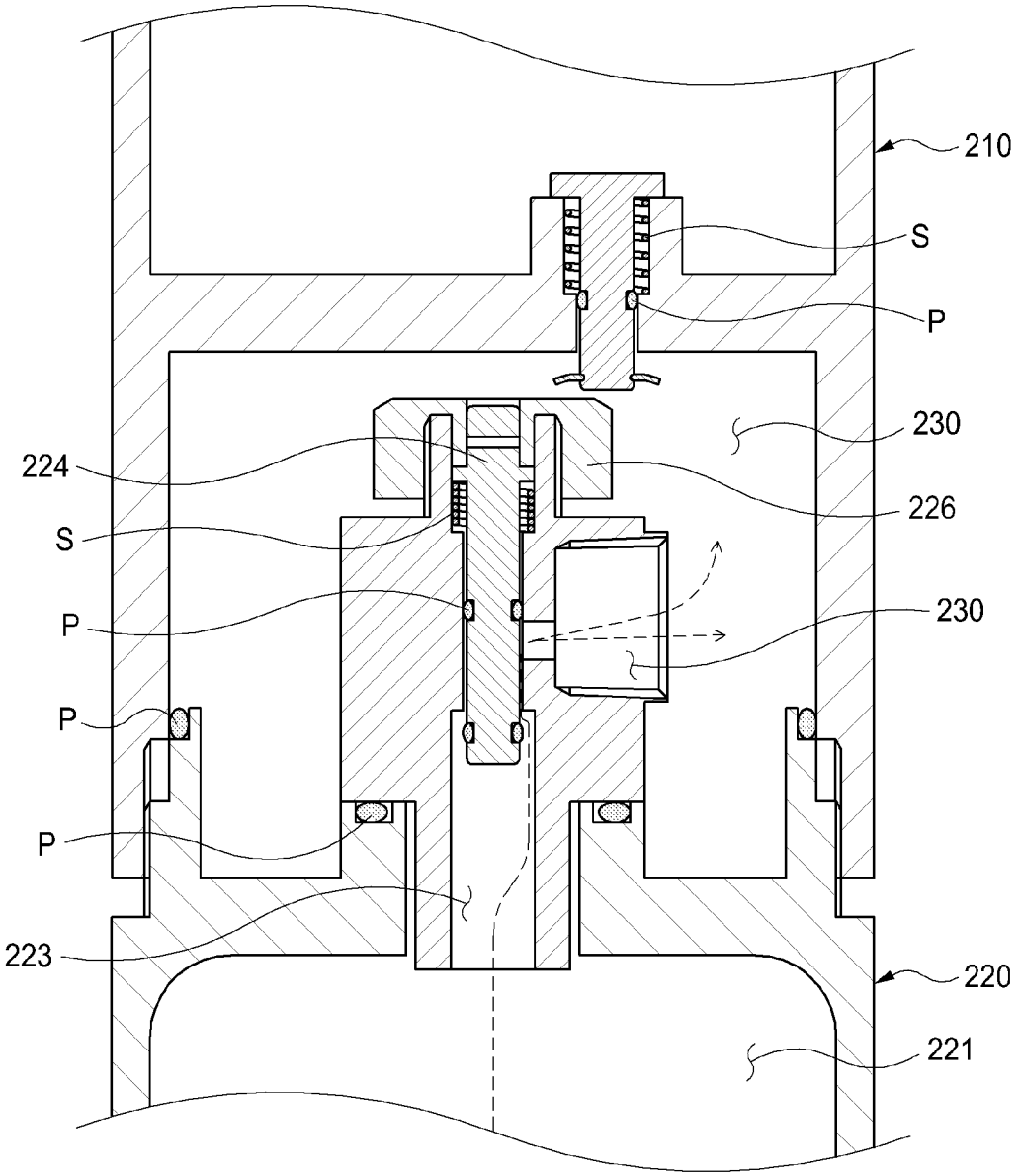

[FIG. 6b]
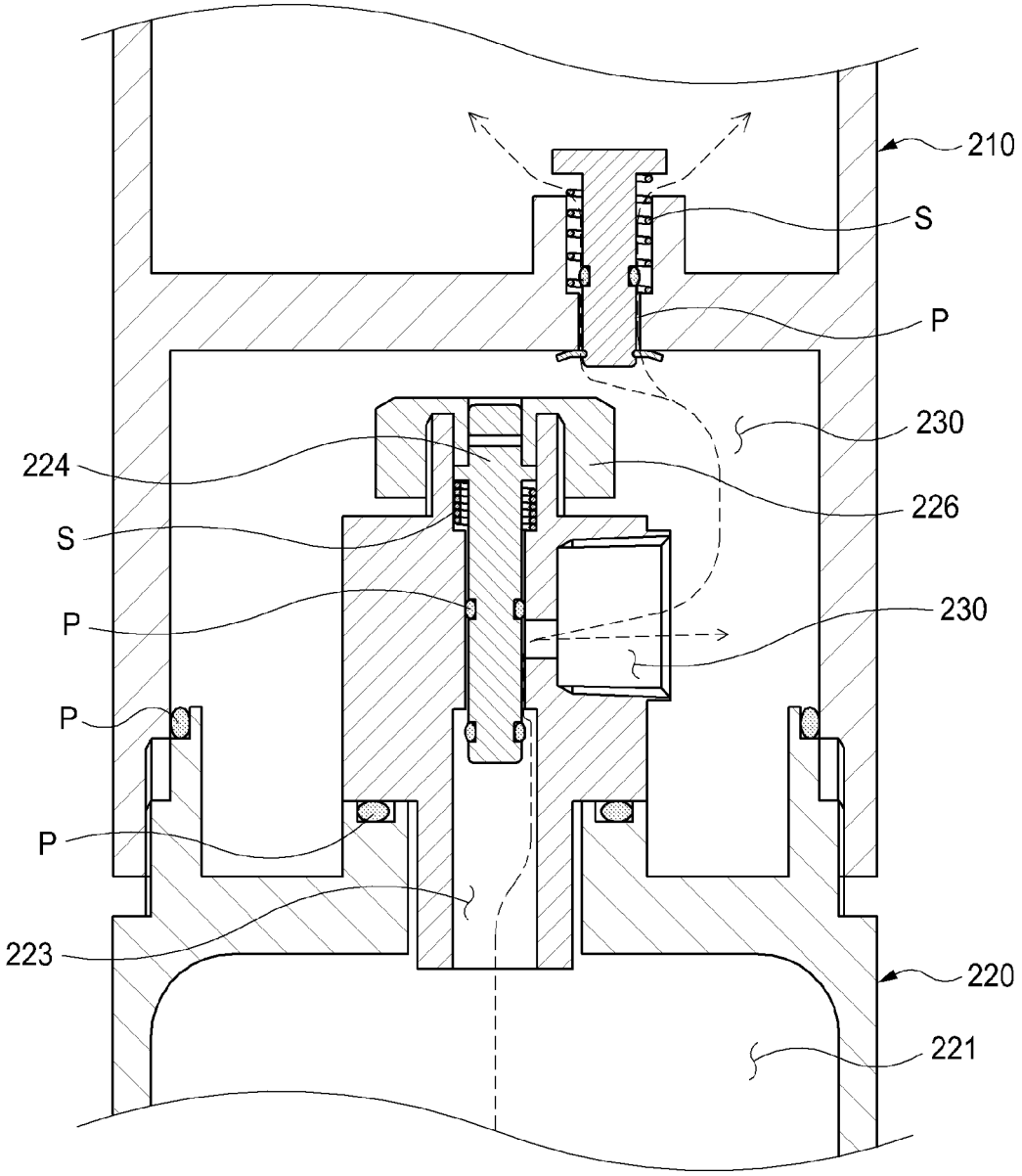

[FIG. 7]
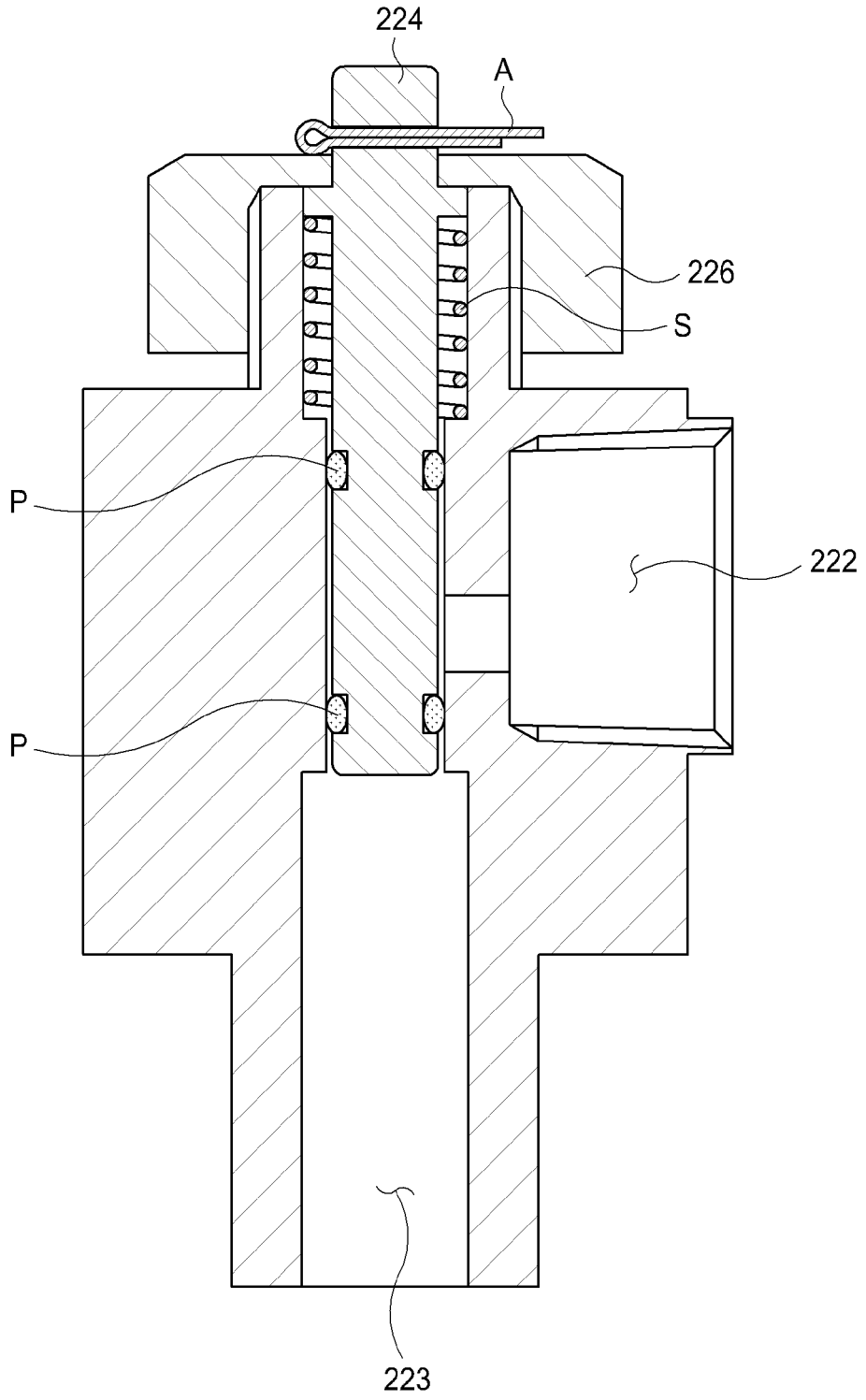

[FIG. 8]
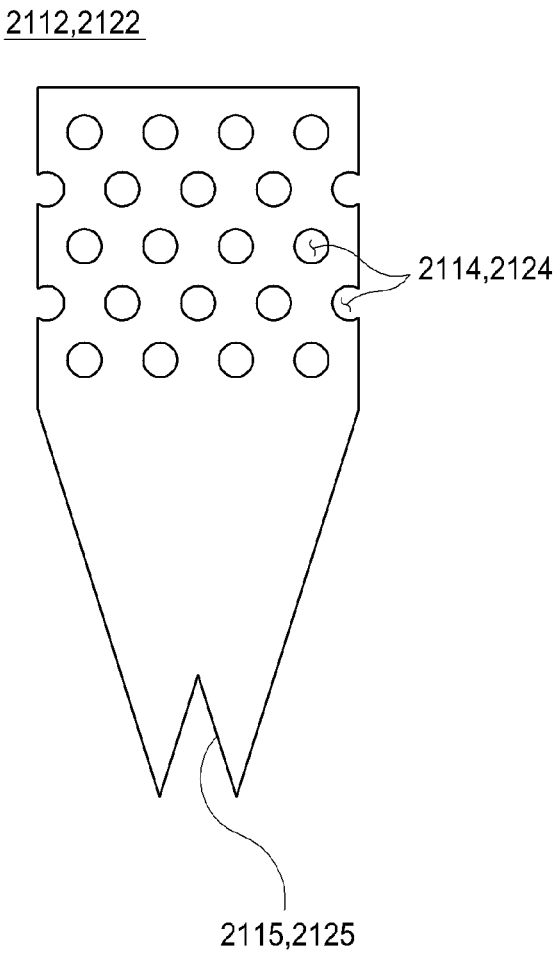

FIRE SUPPRESSION SYSTEM

TECHNICAL FIELD

The present disclosure relates to a fire suppression system, and more particularly, to a fire suppression system for quickly extinguishing a fire by operating a fire extinguisher.

BACKGROUND ART

Fire suppression systems are installed in unmanned buildings or facilities such as transfer rooms and ESS devices such that fire extinguishing agent is sprayed manually or automatically in the event of fire to quickly extinguish the fire to minimize property and human damages.

Accordingly, the fire suppression system has a detector configured to detect a fire in a building or facility, and requires separate equipment such as a pipe to allow the fire extinguishing agent to be automatically sprayed when a fire occurs, resulting in a large installation space and cost In addition, there is no method to solve problems that may occur when the fire suppression system does not work due to a failure or the fire is not properly extinguished due to insufficient ejection pressure of the extinguishing agent. As a result, the fire may get bigger or lead to a secondary accident such as an explosion.

DISCLOSURE

Technical Problem

Therefore, the present disclosure has been made in view of the above problems, and it is an object of the present disclosure to provide to provide a fire suppression system that can be easily installed without separate equipment and can be used more safely by providing a supplementary device.

Technical Solution

In accordance with the present disclosure, the above and other objects can be accomplished by the provision of a fire suppression system including: a detector configured to detect a specific change caused by a fire and transmit a measured value as a measurement signal; a fire extinguisher configured to spray a fire suppression material; a control part configured to receive the measurement signal and transmit an execution signal to the fire extinguisher; and a management part configured to allow a user or an administrator to check whether there is a fire and remotely operate the fire extinguisher, wherein the control part is configured to transmit a notification signal to the management part only when the measured data value exceeds a threshold and to receive the execution signal only when an operation instruction is received from the management part.

The fire extinguisher may include a first fire extinguisher including a heat-sensitive member automatically operated at a temperature exceeding a preset temperature; and a second fire extinguisher operated by the execution signal.

The control part may transmit and receive the notification signal to and from the management part over a communication network, and store the measurement signal received from the detector, wherein the management part may include a central control station or an administrator portable terminal, the management part being capable of checking the stored measurement signal over the communication network even when the notification signal is not transmitted from the control part.

The control part may be connected to a closed circuit television through a wired or wireless communication network to allow areal-time status to be checked through the management part.

The fire extinguisher may include a fire extinguishing cylinder including the first and second fire extinguishers branched from one side so as to be opened when a fire occurs such that a fire extinguishing agent contained therein is sprayed, a ring-shaped extension having the opening formed therein and threads formed along a circumference thereof, and an opening/closing valve configured to open and close the opening by a pressure difference between an inside and an outside; and a gas adapter provided with a gas outlet for the charge of a gas contained therein, the gas adapter being coupled to one side of the fire extinguishing cylinder. Accordingly, the opening/closing valve may be opened and the gas may be introduced into the fire extinguishing cylinder by a pressure difference between the fire extinguishing cylinder and the gas adapter produced as the fire extinguishing agent is discharged.

Each of the first and second fire extinguishers may include an opening cap opened when a fire occurs, and a nozzle exposed to the outside to spray the fire extinguishing agent when the opening cap is opened, wherein the second fire extinguisher may further include an operation valve operated upon receiving the execution signal and may thus be executed by the user.

The gas adapter may include a gas accommodation portion having a second coupling portion formed along a circumferential surface thereof to be coupled to the first coupling portion to define a sealed space; and a gas discharge portion arranged to communicate with the gas accommodating portion and provide with the gas outlet formed on one side thereof and disposed in the sealed space.

The nozzle may include spray holes formed along an outer circumferential surface of the nozzle; and a guide hole at a distal end to guide the fire extinguishing agent to be emitted.

Advantageous Effects

As is apparent from the foregoing, various effects including the following details may be expected from the technical solution of the present disclosure. However, it should be noted that the present disclosure can be established even without exhibiting all the following effects.

The fire suppression system of the present disclosure may enable rapid fire suppression by notifying users as well as the central control center of a fire over a communication network, and may be installed simply without additional equipment. Accordingly, the initial cost may be reduced.

In addition, a control part may provide improved convenience and safety by storing various kinds of information periodically measured by the detector and suppressing the fire at an early stage based on the information.

In this regard, a fire extinguisher may be provided with a second fire extinguisher may be executed remotely by a user, thereby maximizing the effect of improvement of user convenience and safety. Further, it may be provided with a gas adapter to allow the fire extinguishing agent to be sprayed at a constant pressure, thereby minimizing the loss of the extinguishing agent and realizing a compact design.

DESCRIPTION OF DRAWINGS

FIG. 1 is a schematic diagram of a fire suppression system according to an embodiment of the present disclosure.

FIG. 2 is a diagram illustrating an embodiment of the detector, the control part, and the management part of FIG. 1.

FIG. 3 is a cross-sectional view of the fire extinguisher of FIG. 1.

FIG. 4 is a cross-sectional view of the fire extinguisher of FIG. 3 in a separated state.

FIG. 5A is a view illustrating an operation state of the first fire extinguisher of FIG. 3, and FIG. 5B is a view illustrating an operation state of the second fire extinguisher of FIG. 3.

FIG. 6 is an enlarged view illustrating the opening/closing valve and the gas outlet of FIG. 3.

FIG. 7 is a view illustrating an operation state of the fire extinguisher of FIG. 5.

FIG. 8 is an enlarged view of the nozzle of FIG. 7.

BEST MODE

Hereinafter, specific embodiments of the present disclosure will be described in detail with reference to the accompanying drawings. Detailed descriptions of well-known functions or configurations are omitted so as not to obscure the subject matter of the present disclosure.

In addition, while the control part of the present disclosure is described as setting a notification for the user only when the measured data exceeds a threshold, but in this case, the threshold may be set to various values that can be arbitrarily designated by a user or an administrator.

FIG. 1 is a schematic diagram of a fire suppression system according to an embodiment of the present disclosure, and FIG. 2 is a diagram illustrating an embodiment of the detector, the control part, and the management part of FIG. 1. FIG. 3 is a cross-sectional view of the fire extinguisher of FIG. 1, and FIG. 4 is a cross-sectional view of the fire extinguisher of FIG. 3 in a separated state. FIG. 5A is a view illustrating an operation state of the first fire extinguisher of FIG. 3, and FIG. 5B is a view illustrating an operation state of the second fire extinguisher of FIG. 3. FIGS. 6A and 6B show an enlarged view illustrating the opening/closing valve and the gas outlet of FIG. 3, FIG. 7 is a view illustrating an operation state of the fire extinguisher of FIG. 5, and FIG. 8 is an enlarged view of the nozzle of FIG. 7.

Referring to FIGS. 1 to 8, a fire suppression system 10 of the present disclosure may include a detector 100 configured to detect a specific change caused by a fire and transmit a measured value as a measurement signal, a fire extinguisher 200 configured to spray a fire suppression material, a control part 300 configured to receive the measurement signal and transmit an execution signal to the fire extinguisher 200, and a management part 400 configured to allow a user or an administrator to check whether there is a fire and remotely operate the fire extinguisher 200. The control part 300 is configured to transmit a notification signal to the management part 400 only when the measured data value exceeds a threshold and to receive the execution signal only when an operation instruction is received from the management part 400.

The detector 100 detects the state of the installation space, converts information on the state into a measurement signal, and transmits the signal to the control part 300. Specifically, the detector 100 may include various sensors configured to measure the temperature, humidity, carbon dioxide, oxygen concentration, and the like in the installation space. Even when a fire does not occur, the detector measures the state of the installation space at predetermined intervals and transmits the same to the control part 300.

The detector 100 may be configured as multiple sensor nodes that measure and collect state data about an object using sensors, and be installed in each partitioned space.

In a large space, multiple sensor nodes may be arranged spaced apart from each other by a certain distance. Each sensor node communicates with the control part 300 over a communication network such as the Internet, such that a fire occurring in a specific area can be quickly extinguished.

In addition, when the number of sensor nodes exceeds a certain number, a sensor hub to oversee the multiple sensor nodes may be installed for smooth transmission and reception of measurement signals and data collection. The sensor hub is connected to sensor nodes and the control part 300 through the Internet communication network.

The fire extinguisher 200 includes an extinguishing cylinder including first and second fire extinguishers 200 configured to spray an extinguishing agent contained therein when a fire occurs, an extended portion 213 provided with an opening 214 inside thereof and a first coupling portion 2131 formed along a circumference thereof, and an opening/closing valve 215 configured to open and close the opening 214 by a pressure difference between the inside and the outside, and a gas adapter 220 coupled to one side of the extinguishing cylinder 210. Thus, in the event of a fire, the fire extinguisher quickly extinguishes the fire by spraying the fire extinguishing agent.

The first and second fire extinguishers 200 are distinguished from each other according to the execution method and are each branched from one side of the fire extinguishing cylinder 210. The first fire extinguisher 211 further includes a heat-sensitive member configured to automatically operate when the installation space is heated at a temperature above a set temperature. The second fire extinguisher 212 further includes an operation valve 2127 configured to receive an execution signal from the control part 300 and operate remotely.

Hereinafter, for simplicity, the elements included in the first and second fire extinguishers 200 in common will be described first without distinguishing the first and second fire extinguishers 200, and differences will be described later.

Each of the first and second fire extinguishers 200 includes an opening cap 2111, 2121 formed at one branched end of the fire extinguishing cylinder 210 and opened when a fire occurs, a nozzle 2112, 2122 exposed to the outside to spray the extinguishing agent when the opening cap 2111, 2121 is opened, and a first coupling portion 2131 formed in a ring shape at an opposite end to internally communicate with the opening 214 and having a thread formed along an inner circumference thereof.

The opening caps 2111 and 2121 are formed at each branched end. When the temperature of the installation space exceeds a specific temperature, the opening cap 2111, 2121 of the first fire extinguisher 211 is automatically separated outward from the fire extinguishing cylinder 210 by the heat detector formed of a material that is melted at a certain temperature or higher.

On the other hand, the opening cap 2111, 2121 of the second fire extinguisher 212 is connected to the operation valve 2127 configured as a solenoid valve and is opened upper receiving an execution signal transmitted through the control part 300 or a sensor node. It is opened only by the operation of the user.

Accordingly, an operation valve 2127 capable of receiving a signal from the control part 300 or the detector 100 over a communication network, and a battery to supply power to the operation valve 2127 are provided together on one side of the second fire extinguisher 212. The battery may be a lithium ion battery that can be charged by electricity or radio waves or a general battery.

The nozzles 2112 and 2122 are arranged spaced apart from the opening caps 2111 and 2121 by a specific distance. The nozzles are movably installed to be exposed to the outside of one branched end as the opening caps 2111 and 2121 are opened, and the cross-sectional area thereof gradually decreases as they extend toward the end, such that the fire extinguishing agent can be sprayed at a specific speed or higher.

Specifically, a number of spray holes 2114 and 2124 are formed along the outer circumferential surface of the nozzles 2112 and 2122 such that the extinguishing agent can be sprayed in all directions, and thus one fire extinguisher 200 can extinguish a fire over a certain area or larger. At the distal end, guide holes 2115 and 2125 for guiding the agent to be sprayed downward in a certain range of spray angles are formed such that the spray can quickly reach the location where the fire occurs.

In addition, a packing member (P) configured as O-rings 2113 and 2123 is disposed along the outer circumferential surface of the nozzles 2112 and 2122 such that the nozzles 2112 and 2122 may be located at an initial position. Also, bumps 2116 and 2126 are formed at the distal ends of the first and second fire extinguishers 200 of the fire extinguishing cylinder 210 where the opening caps 2111 and 2121 are provided, in order to prevent the opening caps 2111 and 2121 from being displaced from the spray position when the opening caps 2111 and 2121 are opened.

Therefore, by variously changing the arrangement and size of the spray holes 2114 and 2124 and the shape of the guide holes 2115 and 2125 of the nozzles 2112 and 2122 of the present disclosure, the optimal fire suppression system 10 suitable for the place where the system is installed may be provided.

Therefore, as the fire extinguisher 200 of the present disclosure includes the first fire extinguisher 211 that automatically operates in the event of a fire to enable quick fire suppression, and the second fire extinguisher 212 operated by a user or an administrator when the first fire extinguisher 211 fails to operate due to a damage or the like, it may provide improved convenience and safety.

The extended portion 213 is formed in a ring shape at the opposite end of the fire extinguishing cylinder 210, an opening 214 that is opened and closed by pressure is formed therein. Also, a first coupling portion 2131 is formed along an inner circumference of the extended portion and thus the extended portion may be easily coupled to the gas adapter 220.

The opening 214 is formed inside the extension 213 to allow the space containing the extinguishing agent and the sealed space 230 formed by the coupling of the gas adapter 220 to communicate with each other. Thus, it is used as a path through which gas is introduced into the fire extinguishing cylinder 210 in the event of a fire.

The first coupling portion 2131 is formed as threads on one side of the inner side surface of the extended portion 213 so as to be screw-coupled to the second coupling portion 225 formed on the gas adapter 220. Thereby, installation related convenience may be improved. In addition, after a fire occurs, the fire extinguishing cylinder 210 and the gas adapter 220 may be separated and reused.

The first coupling portion 2131 is recessed at the distal end of the extended portion 213 and a protruding coupling end is formed on one side of the first coupling portion 2131 such that the fire extinguishing cylinder 210 and the gas adapter 220 are coupled to each other at a predetermined position. In addition, the packing member P formed on the gas adapter 220 may be disposed on one side of the first coupling portion 2131 to improve the sealing of the sealed space 230, thereby providing improved product reliability and service life.

The opening/closing valve 215 is arranged to be movable in the opening 214 by the tension of an elastic spring S, and a packing member P is formed on one side thereof such that the opening 214 is opened or closed by a pressure difference. Specifically, when the fire extinguishing cylinder 210 is initially filled with a fire extinguishing agent at a high pressure, the opening/closing valve 215 closes the opening 214 as the elastic spring S is comprised by the pressure generated by the fire extinguishing agent. When the extinguishing agent is sprayed to the outside due to the occurrence of a fire, the internal pressure is reduced, and thus the elastic spring S is restored to open the opening 214.

In this regard, a packing member P is provided to the opening/closing valve 215 that closely contacts the inner wall of the opening 214 at a closed position to prevent gas from flowing into the sealed space 230. At the open position of the opening 214, the packing member is moved together with the opening/closing valve 215 and is spaced apart from the inner wall to form a passage through which the gas moves.

The gas adapter 220 includes a gas accommodation portion 221 configured to accommodate gas, a gas outlet 222 allowing the gas to be discharged therethrough, an opening/closing shaft 224 for opening and closing the gas outlet 222, and an opening/closing shaft 224 arranged to open and close the gas outlet 222, and an assembly cap 226 configured to fix the opening/closing shaft 224. The gas adapter is coupled to one side of the fire extinguishing cylinder 210 to supply gas to the inside through the opening 214 to allow the fire extinguishing agent filling the fire extinguishing cylinder 210 to be discharged at a constant pressure and ensure that the entire amount of the extinguishing agent is discharged to the outside.

In addition, a second coupling portion 225 screw-coupled to the first coupling portion 2131 is formed on one side of the gas adapter 220 such that the fire extinguishing part 200 can be connected more simply and easily. In this case, the second coupling a reinforcing end disposed to face the coupling end formed on one side of the first coupling portion 2131 is formed on one side of the coupling portion 225.

Accordingly, the fire extinguishing cylinder 210 and the gas adapter 220 are formed in a complementary structure and are thus more stably coupled to each other. Also, a packing member P may further be formed on one side of the reinforcing end to closely contact one side of the coupling end when the fire extinguishing cylinder 210 and the gas adapter 220 are coupled to each other, thereby enhancing the sealing of the sealed space 230 and improving the service life and reliability of the product.

Specifically, when the gas adapter 220 is not coupled to the fire extinguishing cylinder 210, the opening/closing shaft 224 protrudes from the communication space 223, and is fastened with a safety pin to prevent the gas accommodated therein from being discharged. Before the fire extinguishing cylinder 210 is coupled, the safety pin is removed to allow the internal gas to be supplied to the sealed space 230. Accordingly, when the internal pressure of the fire extinguishing cylinder 210 is reduced and becomes lower than the gas pressure of the sealed space 230 as the extinguishing agent is discharged in the fire extinguisher 200 of the present disclosure, the elastic spring S installed inside the opening/ closing valve 215 is compressed, the opening/closing valve 215 is moved, the opening 214 is opened to allow the gas to introduced. Thus, the pressure inside the fire extinguishing cylinder 210 is increased to support the spray operation.

In this configuration, the opening/closing shaft 224 is provided with an elastic spring S and a packing member P. Thus, when the safety pin remains fixed, the elastic spring S is maintained remains tensioned, and the packing member P is formed on both sides of the gas outlet 222 to prevent the gas from being discharged. When the safety pin is released, the elastic spring S is restored and the opening/closing shaft 224 is moved accordingly, and any one of the packing members P is disposed in the communication space 223, thereby forming a passage through which the gas can move.

The assembly cap 226 has a through-hole having a smaller cross-sectional area than the communication space 223 in which the opening/closing shaft 224 is installed. By fastening the safety pin with the opening/closing shaft 224 partially exposed through the through hole, the gas supplied into in the gap adapter 220 may be prevented from leaking out. After the fire extinguisher is operated due to a fire, only the assembly cap 226 may be separated such that the gas adapter 220 can be reused.

Therefore, the fire extinguisher 200 of the present disclosure provided with the opening/closing valve 215 that opens and closes according to a pressure difference may allow the fire extinguishing agent to be continuously sprayed at a constant pressure, and ensure that the fire extinguishing agent contained inside is completely discharged to the outside.

The control part 300 receives a measured value for a specific state such as a temperature from the detector 100 as a measurement signal, and stores the same. When the measured value exceeds a preset threshold, the control part transmits a notification signal to the management part 400 to enable quick fire suppression.

Specifically, the control part 300 includes a collector server configured to receive the measurement signal transmitted from the detector 100, a register server configured to perform integrated management of authentication and registration of the detector 100, an application server configured to transmit a notification signal or transfer stored information to the management part 400, a Web server configured to manage the real-time status on the web and the control part 300, and a DB server connected to a storage unit 500 configured to receive information from each server and store the same.

Here, the threshold may be selected by a user or an administrator according to the installation space. In general, when a fire occurs and the temperature is higher than a normal temperature of the installation space by a certain value or more, a notification is set for the user.

In contrast, the control part 300 of the present disclosure continuously measures and stores the temperature, and accordingly the user or administrator may set the threshold range such that a notification can be delivered to the user even when the temperature falls below a certain level.

However, in this case, the user must select and install the first fire extinguisher 211 that can be automatically executed when the temperature falls within the set threshold or threshold range. The selection and installation comply with the technical standards of product inspection.

Therefore, the threshold is preferably set by referring to the reaction temperature of a combustion material in the installation space because the fire reaction differs among the combustion materials such as rubber, wood, plastic, paint, and paper, and accordingly the fire extinguishing agent accommodated in the fire extinguishing cylinder 210 may also be changed.

The management part 400 may include a central control station or a portable terminal of an administrator that manages fire suppression. For the central control station, a central control station closest to the location of the fire may be designated over a communication network.

In addition, the notification may be delivered to the user's portable terminal by a priority pop-up such that the user can immediately recognize the notification regardless of the setting state of the portable terminal.

Therefore, as the fire suppression system 10 of the present disclosure includes the control part 300 capable of using a communication network and the management part 400 capable of communicating with the control part 300, the management part 400 may perform immediate control for 24 hours when an abnormal condition occurs. Therefore, system stabilization may be significantly improved.

In addition, measured values may be continuously stored and analyzed through deep learning. Thereby, the fire may be extinguished at an early stage. In addition, the occurrence of a fire may be prevented by analyzing the data about the event of a fire.

Further, i multiple detectors 100 may be employed and easily installed in a small space such as a distribution box as well as a large space such as a building or ESS facility. Thereby, the versatility of the product may be improved. In addition, as the user or administrator is notified of a fire over the existing communication network, and the fire extinguisher 200 operated by the user or administrator is provided, improved product convenience may be provided.

Although preferred embodiments of the present disclosure have been exemplarily described above, the scope of the present disclosure is not limited only to such specific embodiments. Those skilled in the art will appreciate that various modifications, variations and additions can be made to the present disclosure, without departing from the scope and spirit of the disclosure as disclosed in the accompanying claims.

The invention claimed is:

1. A fire suppression system comprising:

a detector configured to detect a specific change caused by a fire and transmit a measured value as a measurement signal;

a fire extinguisher configured to spray a fire suppression material, and comprises a first fire extinguisher including a heat-sensitive member automatically operated at a temperature exceeding a preset temperature, and a second fire extinguisher operated by an execution signal;

a control part configured to transmit a notification signal only when a received measurement signal value exceeds a threshold, and transmit the execution signal only when an operation instruction is received; and a management part configured to allow a user or an administrator to check whether there is a fire depending upon the notification signal, and remotely operate the fire extinguisher, wherein the fire extinguisher comprises:

a fire extinguishing cylinder comprising:

the first and second fire extinguishers branched from one side of the fire extinguishing cylinder so as to be opened when a fire occurs such that a fire extinguishing agent contained therein is sprayed; a ring-shaped extension having an opening formed therein and a first coupling portion formed along a circumference thereof;

and an opening/closing valve configured to open and close the opening by a pressure difference between an inside of the opening/closing valve and an outside of the opening/closing valve; and a gas adapter provided with a gas outlet for a charge of a gas contained therein, the gas adapter being coupled to the one side of the fire extinguishing cylinder, wherein the opening/closing valve is opened and the gas is introduced into the fire extinguishing cylinder by a pressure difference between the fire extinguishing cylinder and the gas adapter produced as the fire extinguishing agent is discharged, and wherein each of the first and second fire extinguishers comprises:

an opening cap opened when a fire occurs; and a nozzle exposed to the outside to spray the fire extinguishing agent when the opening cap is opened, wherein the second fire extinguisher further comprises:

an operation valve operated upon receiving the execution signal, such that the fire extinguishing agent is sprayed by operation of the user.

2. The fire suppression system of claim 1, wherein the control part transmits and receives the notification signal to and from the management part over a communication network, and stores the measurement signal received from the detector, wherein the management part comprises a central control station or an administrator portable terminal, the management part being capable of checking the measurement signal over the communication network even when the notification signal is not transmitted from the control part.

3. The fire suppression system of claim 1, wherein the control part is connected to a closed circuit television through a wired or wireless communication network to allow areal-time status to be checked through the management part.

4. The fire suppression system of claim 1, wherein the gas adapter comprises:

a gas accommodation portion having a second coupling portion formed along a circumferential surface thereof to be coupled to the first coupling portion to define a sealed space; and a gas discharge portion arranged to communicate with the gas accommodating portion and provide with the gas outlet formed on one side thereof and disposed in the sealed space.

5. The fire suppression system of claim 1, wherein the nozzle comprises:

spray holes formed along an outer circumferential surface of the nozzle; and a guide hole at a distal end to guide the fire extinguishing agent to be emitted.

* * * * *